United States Patent [19]

Thompson

[11] Patent Number: 4,793,508

[45] Date of Patent: Dec. 27, 1988

[54] STRUCTURE FOR DETACHABLY RECEIVING AT LEAST ONE RETAINING BOARD IN VARIABLE CONFIGURATION

[76] Inventor: Priscilla B. Thompson, P.O. Box 2160, Arlington, Va. 22202

[21] Appl. No.: 96,789

[22] Filed: Sep. 11, 1987

Related U.S. Application Data

[63] Continuation of Ser. No. 773,566, Sep. 9, 1985.

[51] Int. Cl.[4] ..... B65D 57/00

[52] U.S. Cl. ..... 220/22.1; 220/22; 190/102; 190/110; 206/372; 206/373; 206/425; 206/449

[58] Field of Search ..... 150/52 F, 52 J; 190/18 A, 100, 102, 109, 110; 206/38, 232, 372, 373, 376, 425, 557, 569, 806, 818, 449, 454; 220/22.1, 22; 211/13

[56] References Cited

U.S. PATENT DOCUMENTS

| | | | |
|---|---|---|---|
| 361,248 | 4/1889 | Winton | 206/818 |
| 738,051 | 9/1903 | Meeker | 211/13 |
| 1,430,333 | 9/1922 | Smith | 190/109 |
| 1,683,029 | 9/1928 | Fanyer | 190/18 A |
| 2,299,610 | 10/1942 | Clark | 206/557 |
| 2,342,668 | 2/1944 | Hellyar | 211/13 |
| 2,389,285 | 11/1945 | Vergobbi | 206/3 |
| 2,540,340 | 2/1951 | Linblade | 206/818 |
| 2,733,113 | 1/1956 | Humbargar | 206/818 |
| 3,164,430 | 1/1965 | Beem et al. | 206/425 |
| 3,330,388 | 7/1967 | Stein | 190/110 |
| 3,454,068 | 7/1969 | Goldstein et al. | 190/109 |
| 3,897,871 | 8/1975 | Zinnbauer | 206/449 |
| 4,100,684 | 7/1978 | Berger | 206/818 |
| 4,170,392 | 10/1979 | Spevak | 206/373 |
| 4,212,377 | 7/1980 | Weinreb | 150/52 J |
| 4,215,769 | 8/1980 | Kuc | 190/18 A |
| 4,286,832 | 9/1981 | Spevak | 206/373 |
| 4,330,050 | 5/1982 | Sangster et al. | 190/110 |
| 4,403,638 | 9/1983 | Baum | 150/52 T |
| 4,415,089 | 11/1983 | Ruffa | 211/13 |
| 4,463,789 | 8/1984 | Leiserson | 150/52 J |
| 4,542,777 | 9/1985 | Benson | 190/109 |
| 4,606,463 | 8/1986 | Stavis | 211/13 |

FOREIGN PATENT DOCUMENTS

| | | | |
|---|---|---|---|
| 649906 | 6/1985 | Switzerland | 211/13 |
| 3737 | of 1875 | United Kingdom | 190/109 |

*Primary Examiner*—David T. Fidei
*Attorney, Agent, or Firm*—John J. Byrne

[57] ABSTRACT

A support structure such as but not limited to bags, carrying cases, suitcases, file cabinets and storage boxes, including a pegged matrix base structure for permitting a variable configuration of at least one retaining board received thereon. Each said retaining board would include article holders and is detachable from said container floor for expedient access of articles thereto and from. The rows and columns of pegs receive retaining boards in a guiding relationship for secure but detachable engagement. Articles contained on each board may be separately managed and manipulated apart from those of other boards, and removed from the container floor. Removable article holders may be flexibly coupled to the retaining boards for selective configuration of articles on each board.

13 Claims, 5 Drawing Sheets

FIG. 3B
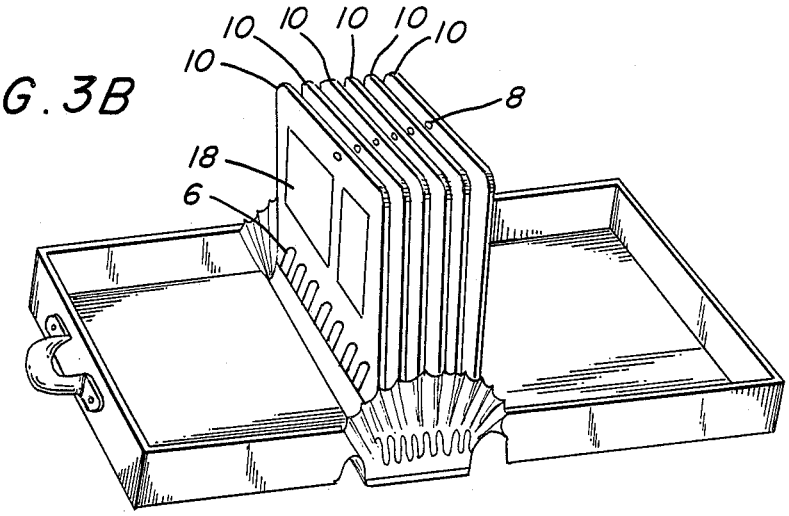
FIG. 1A
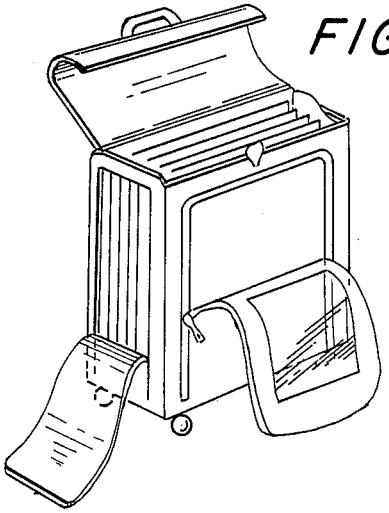
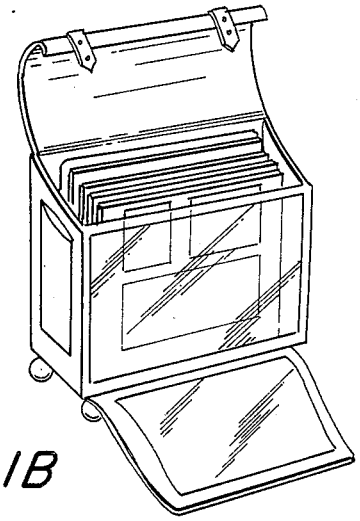
FIG. 1B
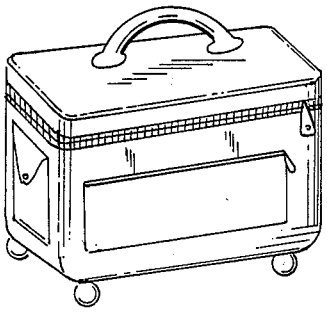
FIG. 1C
FIG. 1D
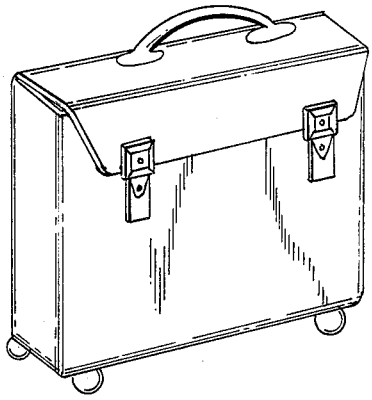

FIG. 1E
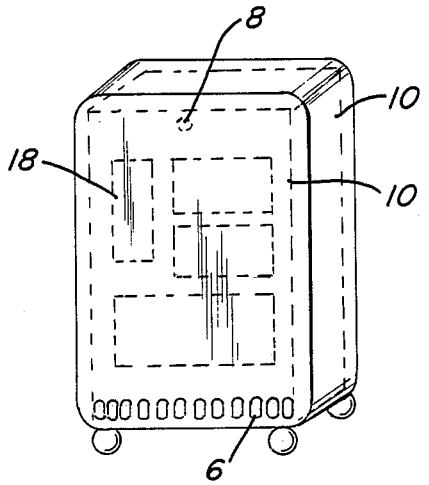
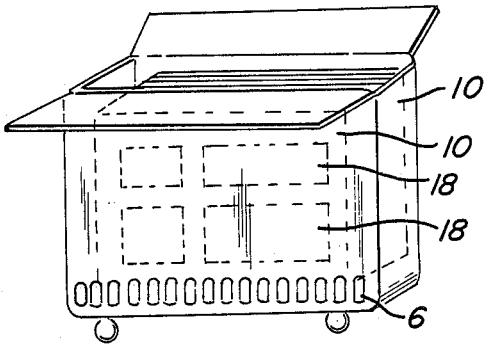
FIG. 1F
FIG. 3C
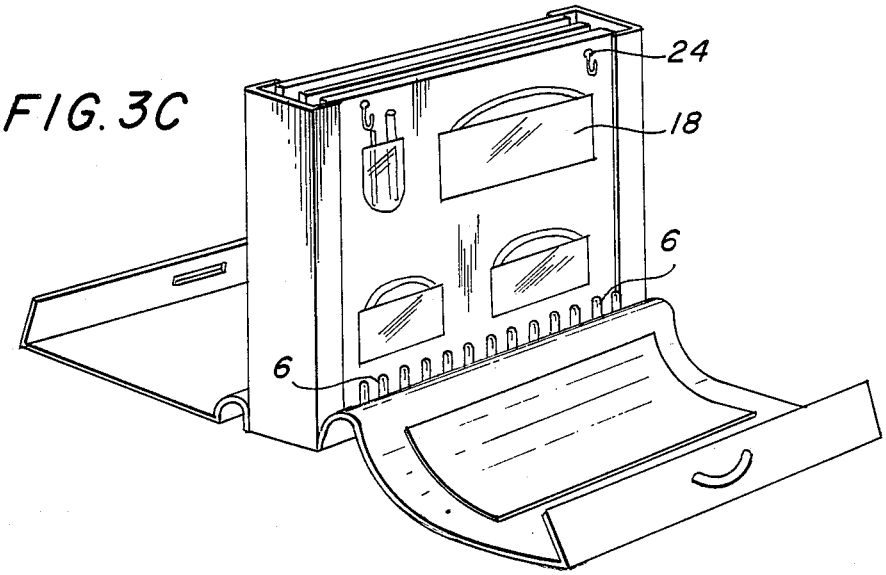

STRUCTURE FOR DETACHABLY RECEIVING AT LEAST ONE RETAINING BOARD IN VARIABLE CONFIGURATION

This application is a continuation of application Ser. No. 773,566 filed Sept. 9, 1985.

BACKGROUND OF THE INVENTION

The subject invention relates to a container for holding articles, including but not limited to attache cases, travel cases, and suitcases, file cabinets and storage boxes.

Containers and cases are used for holding and carrying articles. They protect articles contained therein and offer manageability in transporting them. Articles for transportation are bundled together in a case for manipulation as a single consolidated item instead of numerous separate elements of different shapes and sizes. Ironically, this major benefit derivable from a case is also closely linked to a source of disadvantages in some cases. If consolidation is well planned and organized, then the utility of a case is maximized; however, if consolidation is achieved without proper means for organization, as is often the case with the prior art, time and energy will be wasted to sort out the various articles and to retrieve these articles from a case.

Some common problems of prior art cases are that articles contained therein are not easily accessible. More often than not, the entire case must be juggled, handled, and manipulated with great effort in order to load or to retrieve particular articles therein. The entire case is one single container. Organization is also a problem; articles of different mix are not properly separated. This problem increases the difficulty in expediently retrieving particular items from a case. The extent of this problem is further magnified by difficulty of access mentioned above. The effectiveness of an organizational scheme can often be diminished by difficulties in access and manipulation of the container during implementation.

A significant advance in the container art occurred when predefined fixed compartments and even removable panels insertable in predefined structural grooves are used for enhancing user convenience and organization. Some removable holding members contain pockets and even variably positionable removable pockets thereon. These advances tend to enhance the manageability and organization of containers or cases for users; however, significant room for improvement remains. The flexibility and organization they provide are still limited and do not make available a truly variable case compartment configuration for ultimate flexibility.

The problems remaining as suggested in the above proceedings are not intended to be exhaustive, but rather are among many which may tend to reduce the effectiveness of prior art cases. Other noteworthy problems may also exist; however, those presented above should be sufficient to demonstrate that an unflexible organizational configuration in a case is undesirable.

The instant invention greatly enhances the organization of articles in a container and ease of access in loading and retrieving articles therefrom. A plurality of re-configurable retaining boards having article holders thereon is provided for easy insertion and removal from a container having means for securely but removably receiving the same.

OBJECTS OF THE INVENTION

It is an objective of the instant invention to provide a container permitting more expedient and convenient access to articles contained therein.

It is an objective of the instant invention to provide a container with enhanced organizational features.

It is a specific object of the instant invention to provide at least one retaining board including article holders thereon, for secure but removable coupling to a container floor.

It is a specific object of the instant invention to provide a container having pegged structural floor design for securely but detachably receiving retaining boards in varying and selective configurations, particularly, in a plurality of selectively distinct angular orientations.

It is a specific object of the instant invention to provide article holders in detachable and selectively configurable engagement with a retaining board selectively removable from a container floor.

It is a specific object of the instant invention to provide hooks on a retaining board removable from a container floor and including article holders, for hanging the same while removed from the container floor.

It is a specific object of the instant invention to provide article holders such as pockets of varying shapes and sizes on retaining boards selectively removable and configurable on a container floor.

It is also an objective of the instant invention to effect a combination of the foregoing objectives.

SUMMARY OF INVENTION

A container support structure including a plurality of elongated pegs prearranged in a matrix configuration affixed to the container base, for securely but removably receiving one or more retaining boards insertable therein. The matrix arrangement of preformed elongated pegs provide a wide range of flexibility and thus enhanced manageability of boards inserted therein. Organization of articles within the container is facilitated by the flexibility provided by the pegged base structure.

BRIEF DESCRIPTION OF DRAWINGS

FIGS. 1A–1F illustrate a view of container cases in various shapes and sizes which may embody the instant invention.

FIG. 3B illustrates an elevational view of an opened suitcase in accordance to a preferred embodiment of the instant invention.

FIG. 3C illustrates an elevational view of an opened suitcase in accordance to a different preferred embodiment of the instant invention.

DETAIL DESCRIPTION

Referring now to the figures wherein like numbers indicate like parts, FIGS. 1A, 1B, 1C, 1D, 1E, and 1F illustrate a view of some of the various cases which may embody the subject invention. Cases of all kinds whether they include wheels, zippers, and soft coverings, may embody the instant invention. FIGS. 1B, 1E and 1F include a transport view of its internal structure having a plurality of retaining boards.

Figure 2A:
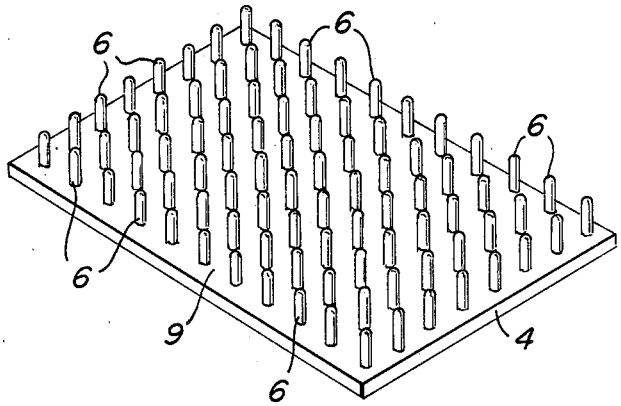
FIG. 2A illustrates the pegged floor structure of a container in accordance with the subject invention.
Figure 2B:
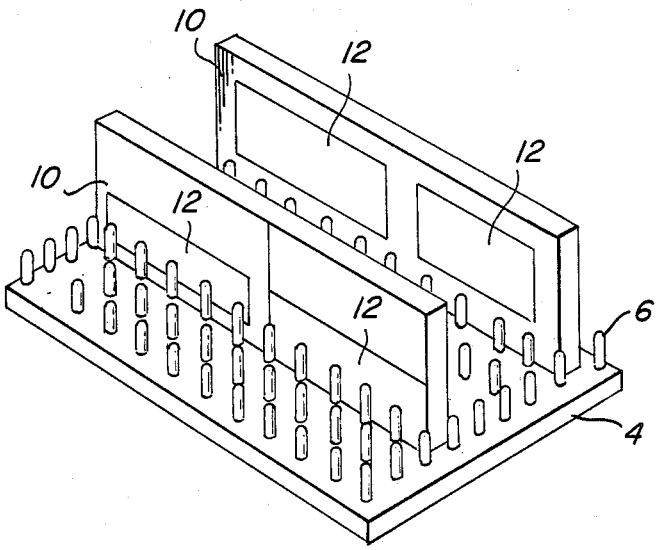
FIG. 2B illustrates the pegged structure of FIG. 2A including retaining boards detachably inserted thereon in guiding relationship to the pegs.

FIG. 2A illustrates the base of a container in accordance to a preferred embodiment of the instant invention. Elongated pegs 6 prearranged in a matrix configuration are affixed to the floor 4. The various rows and columns of these pegs define gaps 9 therebetween for securely but removably receiving retaining boards of varying size. FIG. 2B illustrates a number of retaining boards 10 slidably inserted in various gaps and in frictional engagement with guiding pegs. Some boards need not run the entire length or width of a corresponding row or column of pegs. These boards serve to selectively divide available floor space into desired compartments of varying configuration, and to permit expedient and discrete retrieval of each board for accessing articles to and from article holders 12 coupled to the planar surfaces of the boards. The pegs 6 are preferably of generally rounded and smooth configuration so as to facilitate contact with articles and boards. However, it is intended that pegs of other shape are also within the purview of this invention.

Figure 3A:
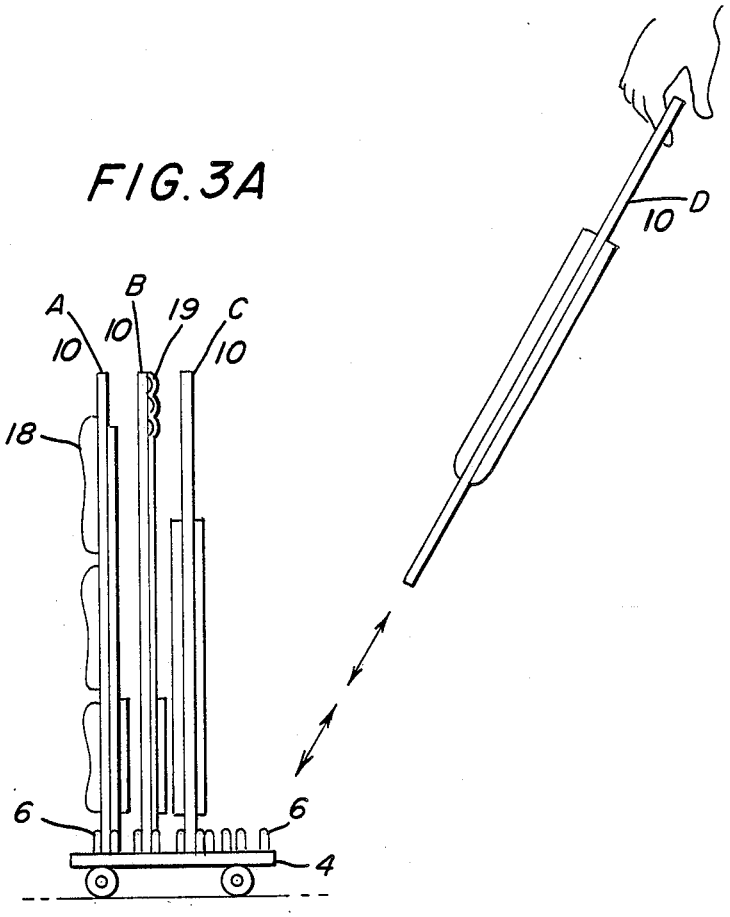
FIG. 3A illustrates a side view of a plurality of retaining board in secure but detachable engagement with a pegged container floor according to the subject invention.

FIG. 3A illustrates a side view of a plurality of retaining boards 10 in frictional engagement with guiding pegs 6 on a container floor 4 in accordance to a preferred embodiment of the subject invention. These boards as shown include article holders such as pockets 16 and clips 19 in varying sizes for retaining cloth articles of various sorts. Boards A, B, and C are insertedly reduced the base as shown, while board D is shown removed from the floor by a user desiring to access articles to and from article holders on the board. This portability of each retaining board permits easy and expedient access to articles contained thereon, since articles are contained directly in article holders on the boards. Also, this portability of each retaining board supporting article holders thereon, and selective configuration of the boards on the case floor enhances organization of articles in the container. It is no longer necessary to manipulate or to juggle an entire container in order to access articles therefrom. The board containing or to contain a desired article may be selected and removed from the for enhanced manageability, and subsequently reinserted to the base in selected configurational relative position to other boards, if any.

An opened suitcase embodying the instant invention is shown in FIG. 3B. Each retaining board 10 is separately received in frictional engagement with the pegged case floor and may be separately removed. Each retaining board includes a varying combination of article holders 18 of different shapes and sizes. FIG. 3C illustrates an elevational view of a different case also embodying the instant invention.

Figure 4:
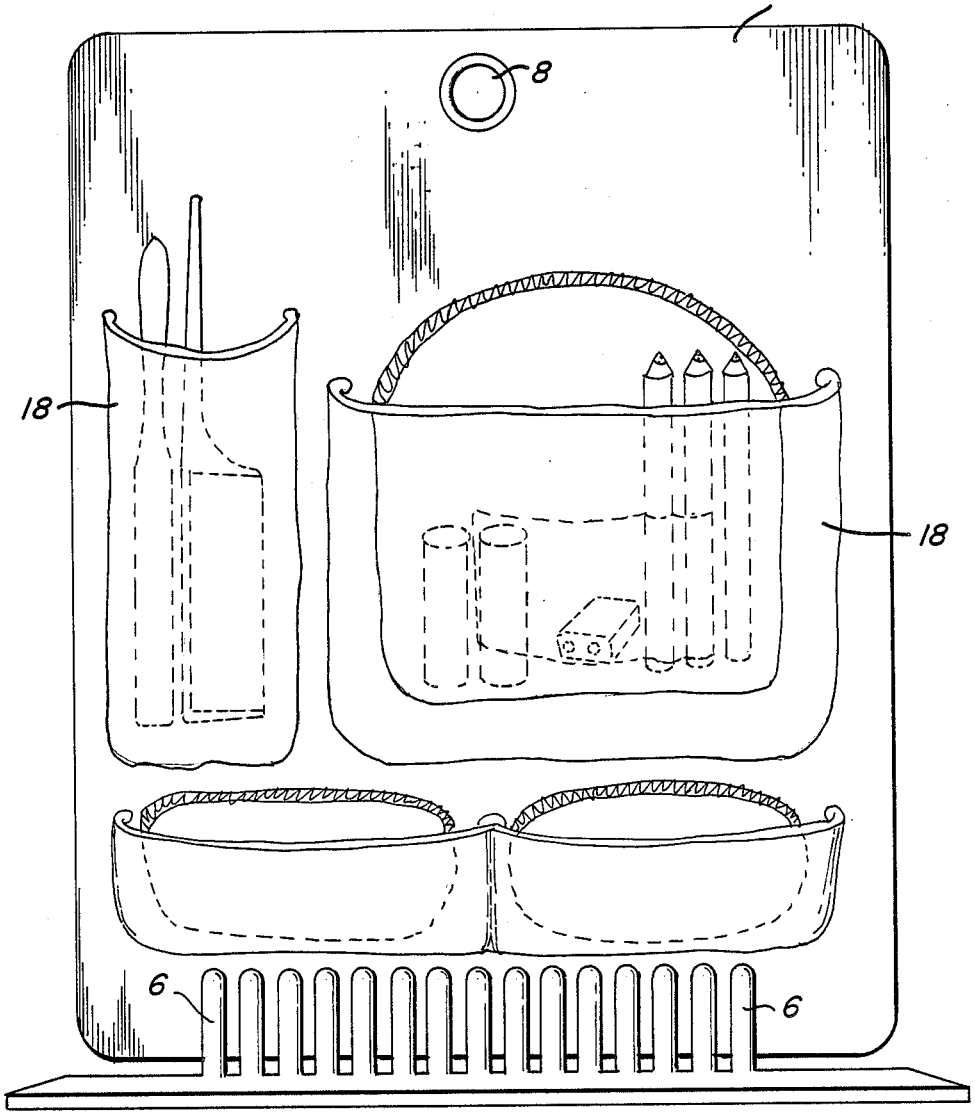
FIG. 4 illustrates one planar surface of a retaining board, on which article holders are attached.

FIG. 4 illustrates the retaining structures on a retaining board. On this particular board 10, article holders 18 including four compartments are included for containing combs, brushes, lipsticks and the like. On other boards, there may be larger pockets for holding clothes such as shirts, trousers, coats and the like. The shape and sizes of these article holders are in general unlimited. Furthermore, there may be article holders on either side of the board. As shown, the board of FIG. 4 is in plugged relationship affixed by the pegs 6; but it may be selectively removed and reinserted by the user. Aperture 8 enables the board to be hung when removed from the pegged floor.

In some instances, items other than article holders such as pockets may be coupled to the board surface. For instance, swivel hooks 24 of FIG. 3C (not shown in FIG. 4) may be included for hanging a board removed from the container floor. A board so hung provides even greater manageability for accessing articles thereto and from.

At this point it should be noted that article holders may be attached to retaining boards in any number of many ways. They may be fastened by way of, fasteners, sewn by way of stitches, adhered by way of velcro type material, attached by way of magnets, or any means of attachment known to those skilled in the art. If the article holders are themselves selectively arrange able on the retaining boards, the utility of the instant invention can be further enhanced for convenience and organization. However, this feature would be an obvious choice of design known to one with ordinary skill in the art. The reconfigurability of article holders would add to the advantages of the disclosed embodiments.

If velcro type material is used, then the retaining board must include a velcro layer on a portion of its surface for adhering to a similar layer on an article holder.

If magnets are used, then either the retaining board or an article holder should include a metallic plate on a portion of its surface for holding on to magnets coupled to the other.

Figure 5:
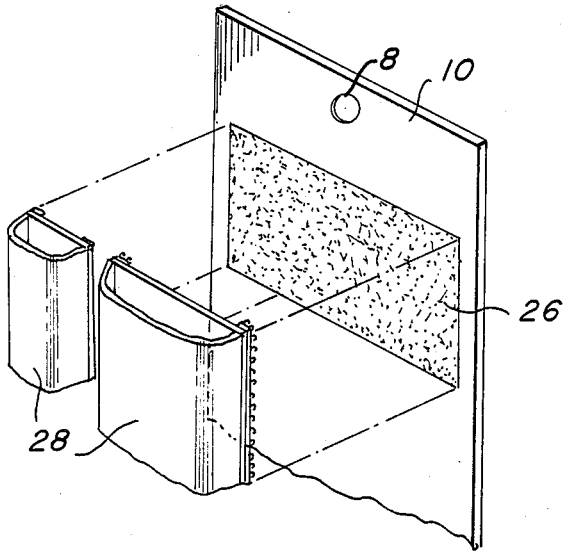
FIG. 5 illustrates article holders such as pockets coupled to boards in a detachable manner via releasable connecting means like velcro strips or magnets and metal sidings.

Whatever the scheme of removably affixing article holders on a retaining board, it is possible to provide a plurality of affixable positions on a retaining board for each article holder. FIG. 5 shows a large velcro layer 26 on a retaining board 10 so that pockets 28 may be affixed in a variable number of other positions. In this manner, the smaller a pocket is the more variable positions there are on a board for placing it.

Certainly, in other embodiments of the subject invention, each article holder may be non-removably affixed to a corresponding retaining board.

It also should be noted at this point that the retaining boards need no always be planar in shape. The matrix of pegs permit insertion of boards having angled surfaces thereon. This capability is also one not achievable by structurally continuous predefined grooves of the prior art.

In describing the subject invention, reference has been made to certain preferred embodiments. Those skilled in the art, however, and familiar with the disclosure of the subject invention, may recognize additions, deletions, substitutions, modifications and/or other changes which will fall within the purview of the invention as defined in the following claims.

I claim:

1. A support structure comprising:

at least one retaining board;

a base including a planar array of spaced and upstanding pegs of flexible construction;

said at least one retaining board being removably mounted securely on said base and between at least two of said upstanding pegs;

each pair of adjacent upstanding pegs of flexible construction define a corresponding gap therebetween and are jointly operative to receive securely one said retaining board in a plurality of variable configurations;

at least one of said retaining boards supports an article holder on one surface thereof;

each said retaining board being selectively removable from each secured position on said base independently of any other retaining board.

2. A structure is recited in claim 1, wherein said plurality of variable configurations includes one such configuration wherein at least two of said retaining boards are disposed in a non-parallel relationship.

3. A structure as recited in claim 1, wherein said flexible and upstanding construction of said pegs enable a pair of adjacent pegs to securely receive in a frictional guiding relationship in the gap between them a retaining board wider than said adjacent pegs are spaced apart along said base.

4. A structure according to claims 1 or 3, further comprising:

coupling means for removably affixing said article holder to a corresponding said retaining board.

5. A support structure according to claim 4 wherein said article holder includes a pocket.

6. A structure according to claim 5 wherein said coupling means employs velcro type material.

7. A support structure according to claim 4, wherein, said coupling means is operative for removably affixing said article holder to a plurality of alternative positions on a corresponding said retaining board.

8. A support structure according to claim 7 wherein said article holder includes a pocket.

9. A structure according to claim 1 wherein said pegs are operative to receive within gaps therebetween said at least one retaining board frictionally in a guiding relationship.

10. A structure according to claim 1 or 3 wherein each said peg has a generally smooth and rounded external surface for facilitating varying angular contact with said at least one retaining board.

11. A structure according to claim 10 wherein each retaining board supports at least one article holder thereon.

12. A structure according to claim 11 further comprising:

coupling means for removably affixing said article holder to a corresponding said retaining board.

13. A structure as recited in claim 4, wherein said coupling means includes a magnet on either said article holder or a corresponding said retaining board, and a metallic surface on the other.

* * * * *